United States Patent [19]

Oye et al.

[11] 4,114,965

[45] Sep. 19, 1978

[54] MEDICATION DISPENSING CART

[75] Inventors: Lloyd J. Oye, Rancho Palos Verdes; Barry Ogden, Rolling Hills Estates, both of Calif.

[73] Assignee: Trans-Aid Corporation, Carson, Calif.

[21] Appl. No.: 738,802

[22] Filed: Nov. 4, 1976

[51] Int. Cl.[2] ..... A47B 81/00

[52] U.S. Cl. ..... 312/209; 312/71; 312/237; 312/250; 312/290

[58] Field of Search ..... 312/209, 290, 71, 72, 312/286, 237, 250, 245

[56] References Cited

U.S. PATENT DOCUMENTS

| | | | |
|---|---|---|---|
| 764,529 | 7/1904 | Ingalls | 312/71 |
| 893,155 | 7/1908 | Evans | 312/209 |
| 1,916,509 | 7/1933 | Hammer | 312/245 |
| 2,039,901 | 5/1936 | Hawley | 312/209 |
| 2,468,497 | 4/1949 | Johnson et al. | 312/71 |
| 2,531,444 | 11/1950 | Lane | 312/290 |
| 2,534,169 | 12/1950 | Hope | 312/71 |
| 2,786,337 | 3/1957 | Spring | 312/237 |
| 3,656,587 | 4/1972 | Siegel | 312/250 |
| 3,715,148 | 2/1973 | Beals | 312/209 |
| 3,988,909 | 11/1976 | Catapano | 312/209 |

FOREIGN PATENT DOCUMENTS

| | | | |
|---|---|---|---|
| 1,037,462 | 9/1953 | France | 312/290 |
| 2,125,004 | 11/1972 | Fed. Rep. of Germany | 312/237 |

*Primary Examiner*—Kenneth Downey
*Assistant Examiner*—Victor N. Sakran
*Attorney, Agent, or Firm*—Warren T. Jessup

[57] ABSTRACT

A portable medication dispensing cart comprised of a cabinet portably mounted on casters and a plurality of medication drawers or bins which are convenient and easy to use. The cabinet includes swing-away doors that lock to provide security as well as a vertically oriented automatic locking drawer for controlled drug security. The medication drawers are installed in removable and interchangeable racks or cassettes. The rear of the cabinet has a tilt-out panel supporting a waste receptacle communicating with an aperture in the upper surface of the cabinet when the panel is in the closed position. The top or working surface of the cabinet is provided with a flexible holder for a removable lamp and a variable size cup dispenser accessible through an aperture in the top surface. The cabinet has all-around bumper protection both top and bottom with the top bumper providing handles at each end of the portable cabinet. Cabinet mounted knobs or socket balls engage keyhole slots in a bracket fastened to a wall to secure the cart when not in use.

4 Claims, 9 Drawing Figures

MEDICATION DISPENSING CART

BACKGROUND OF THE INVENTION

This invention relates generally to portable carts and in particular to a portable medication dispensing cart.

Portable medication carts in the past have been designed mostly for portability with not much thought being given to the efficiency of its use. To be efficient the cart should be easily accessible for the person using it, while providing ease of portability and security for the medicines as well as maximum security possible for controlled drugs. In addition to dispensing medicine, the cart should also provide for disposal of waste as well as cup dispensing and lighting for use when dispensing medicines during the night hours.

Previous medication carts have merely been cabinets with a plurality of drawers in which to store medicines for dispensing to patients during prearranged times. Frequently the drawers are inconvenient to use and are at a low level, creating a great deal of fatigue from stooping and straining during use. They also have provided for carrying cups as well as waste disposal units on the exterior surface which are unsightly as well as unsanitary and provide a potential hazard of catching or bumping articles when the cart is being moved about.

SUMMARY OF THE INVENTION

The purpose of the present invention is to provide a medicine dispensing cart which provides maximum efficiency while still providing a high degree of security and convenience for the user.

The medication cart is comprised of a cabinet supported on high-quality casters for easy portability and has all the dispensing units and waste disposal units completely enclosed in the cabinet and easily accessible. The cabinet has swing-away doors which fold back and latch in the open position for easy access to the medication dispensing bins and drawers. The medication bins are stacked in cassettes or racks at a high level to minimize fatigue during use. The racks or cassettes are supported on rails and are readily removable to convert the arrangement of drawers or replace the entire cassette. A novel feature of the medication cart is the vertically oriented maximum security controlled drug drawer which is accessible from the top and sides, allowing the medication dispensing bins to be placed at a high level. The controlled drug drawer has an automatic locking feature which causes it to lock any time it is in the fully closed position.

The cabinet itself has a hollow interior with a partition separating the medication dispensing bins or drawers from the vertical oriented drawers for the controlled drugs. In the rear of the cabinet is a tilt-out panel having a narrow elongate waste disposal receptacle which is in communication with an aperture in the top or working surface of the cabinet when the tilt-out panel is closed. Below the waste-receiving receptacle is a waste bag dispensing unit which automatically dispenses a waste bag into the waste receptacle when a full bag is removed. A second aperture in the working surface of the cabinet contains a cup dispensing tube which has an adjustable or variable feature for permitting the dispenser to be used with various size cups. The working surface of the cabinet also has a tray-receiving bracket and a flexible arm having a bracket for supporting a flashlight or other portable illuminating means.

The top and bottom periphery of the cabinet is provided with a resilient bumper to protect the surfaces contacting the cabinet as well as protecting the cabinet itself. The opposite ends of the working surface at the top of the cabinet are provided with handles between the bumper and the working surface for pushing or pulling the cart from either end. On the rear surface of the cabinet are knobs or socket balls which engage brackets attached to a wall at the nurse's station for immobilizing the cart for use as a medicine cabinet when not being used as a portable cart.

It is one object of the present invention to provide a medication dispensing cart which is convenient and easy to use.

Another object of the present invention is to provide a portable medication cart which is designed to minimize fatigue during use.

Another object of the present invention is to provide a portable medication cart having a vertically oriented drawer for dispensing and securing controlled drugs.

Another object of the present invention is to provide a medication cart in which all the utilities are completely enclosed in the cabinet.

Another object of the present invention is to provide a medication cart which has a variable size cup retaining dispenser.

Another object of the present invention is to provide a medicine cart which may be readily secured to a wall when not in use.

Still another object of the present invention is to provide a portable medication cart which provides a plurality of medicine dispensing bins and removable racks for removing and revising the arrangement of drawers at will.

Other objects, advantages and novel features of the invention will become apparent from the following detailed description of the invention when considered in conjunction with the accompanying drawings wherein like reference numbers identify like parts throughout.

DETAILED DESCRIPTION OF THE PREFERRED EMBODIMENT

Figure 1:
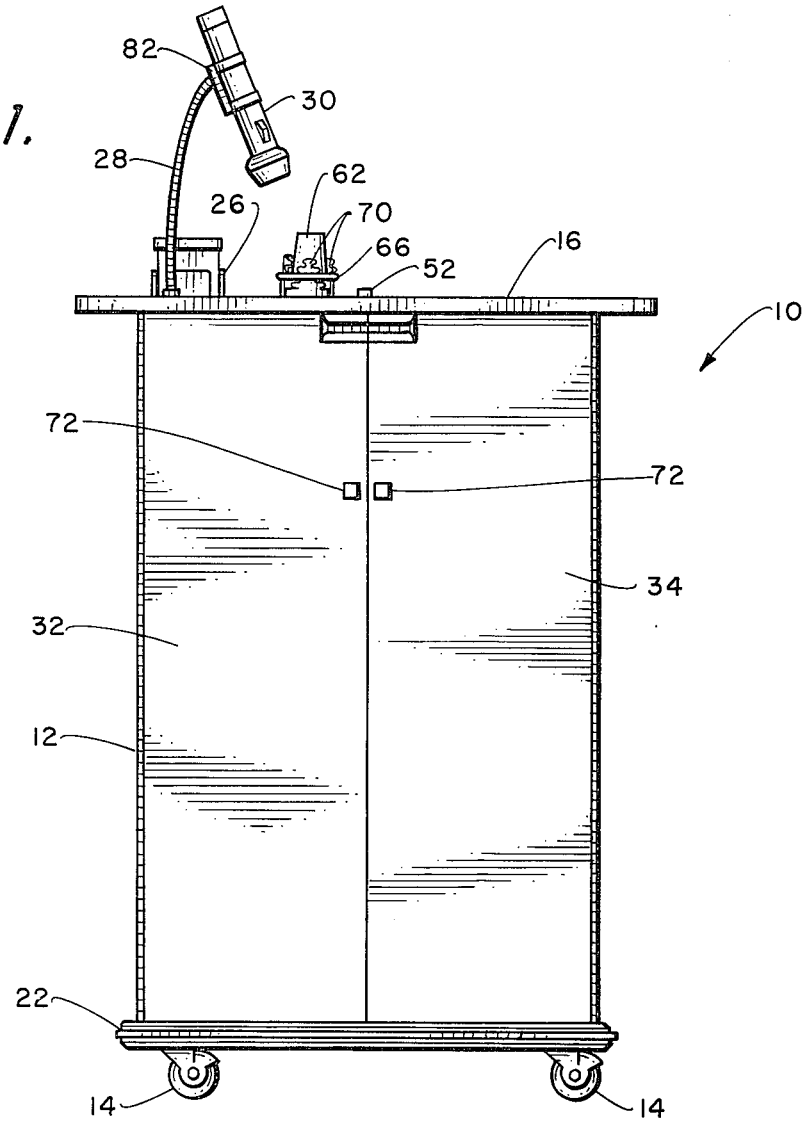
FIG. 1 is a front elevation of the portable medication cart.
Figure 2:
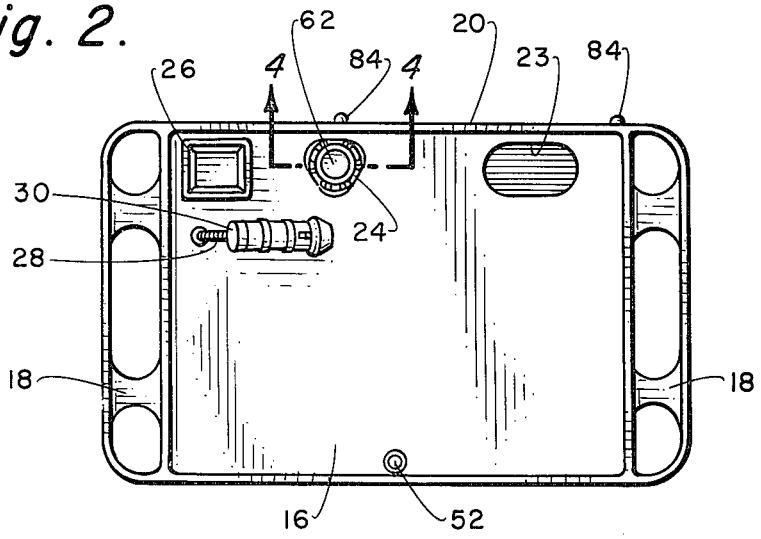
FIG. 2 is a top view of the medication cart.

A portable medication cart is shown generally at 10 in FIG. 1 and is comprised of a cabinet 12 having a hollow interior and a plurality of casters 14 attached to the bottom so that the cart may be easily rolled around a hospital floor. The cabinet 12 is provided with a top or working surface 16 having handle extensions 18 at either end. Entirely around the upper and lower periphery of the cabinet 12 are bumpers 20 at the top and 22 at the bottom to protect the cabinet and also walls and woodwork when bumped. The cabinet is provided with a waste-receiving aperture 23 and a cup-dispensing aperture 24 in the upper working surface 16. In addition, a tray-holding bracket 26 and a flexible arm 28 for supporting a flashlight 30 or the like is provided.

Figure 3:
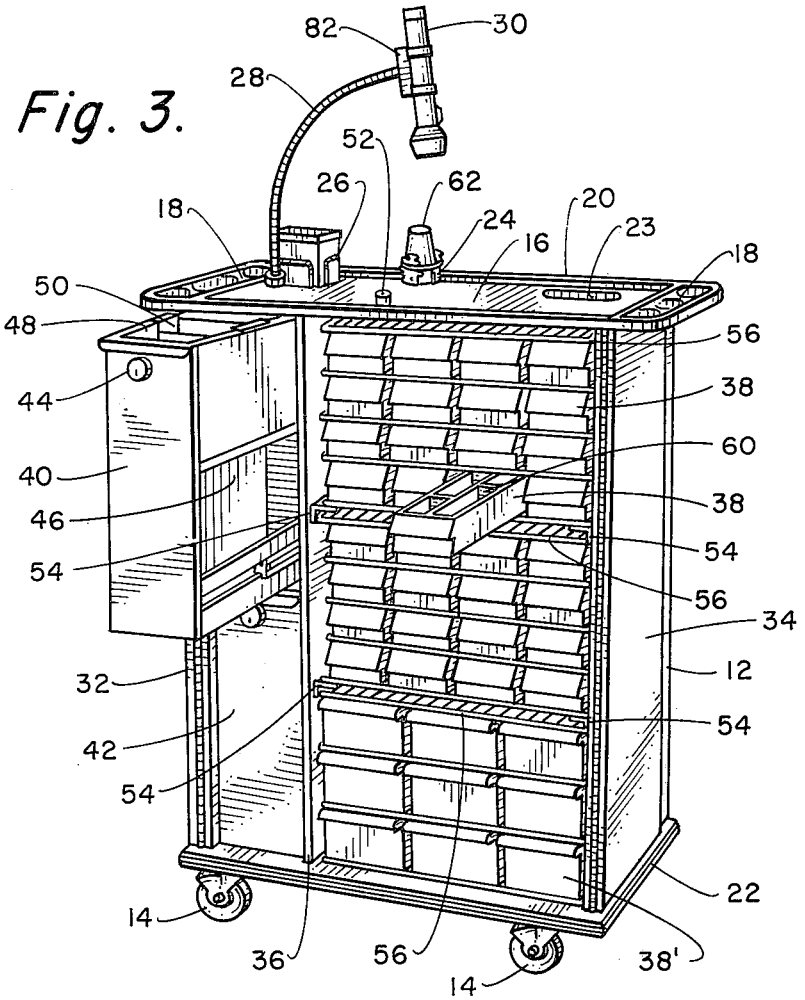
FIG. 3 is a perspective view of the medication cart with the doors open.

FIG. 3 is a detail perspective view of the drawers and bins for storing medications. The hollow interior of the cabinet is accessible through the front doors 32 and 34 which swing completely out of the way against the sides of the cabinet 12. In the cabinet 12 shown the front compartment is separated by a partition 36 which provides two smaller compartments for medicine bins or drawers 38 and a narrower compartment for vertical controlled drug drawer 40. The lower vertically oriented drawer 42 provides secured storage for floor supplies.

The controlled drug drawer 40 has an automatic lock 44 to provide a high degree of security. In addition, the vertical orientation of the drawer allows the medicine storage bins 38 to be placed at a high level to eliminate considerable fatigue from bending and squatting. The drawer 40 has one compartment 46 accessible from the side and an upper compartment 48 accessible from the top. If desired, the top compartment 48 may have a slideable tray 50 for smaller containers supported on the upper lip of the drug drawer 40. When fully closed the drawer 40 automatically locks and requires a key for opening. In addition, the front doors 34 and 32 are also capable of being secured by lock 52 after closing.

Figure 9:
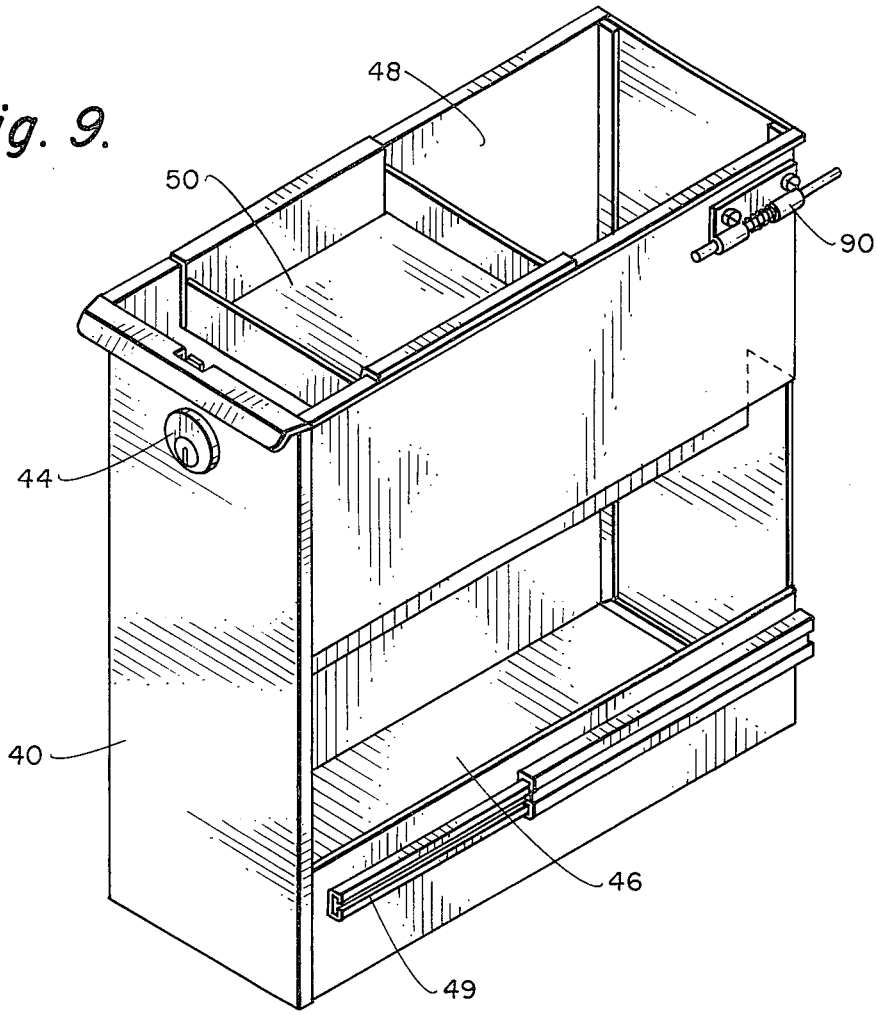
FIG. 9 is a detail view of the automatic secured drawer for controlled drugs.

The automatically lockable narcotics drawer 40 is shown in greater detail in FIG. 9. The drawer is provided with three compartments giving full visability and accessibility to controlled drugs from the top and side and is key lock secured. The drawer has a large compartment 46 accessible from the side and upper compartment 48 easily accessible from the top and a slideable tray 50. The drawer is provided with an inner side glide 49 at the bottom portion, and an upper side glide near the top on the opposite side, which provides greater rigidity of the system and better and more durable alignment of the drawer 40.

To accommodate various size medication drawers or bins 38, the compartment is separated into three smaller compartments by rails 54 which support cassettes or racks 56 containing the medicine drawers 38. These racks 56 are removable and provide for various size medicine storage drawers 38. This permits the cart to be arranged in whichever manner is the most convenient for the particular user. For example, as shown in FIG. 3, large drawers or bins 38 are provided in the bottom rack which may be for less often used or larger containers. The upper drawers 38 are provided with dividers 60 which are adjustable to any number of positions. The racks or cassettes 56 also permit the cart to be changed from non-locking drawer cassettes to locking drawer cassettes in any or all positions, if desired.

Figure 4:
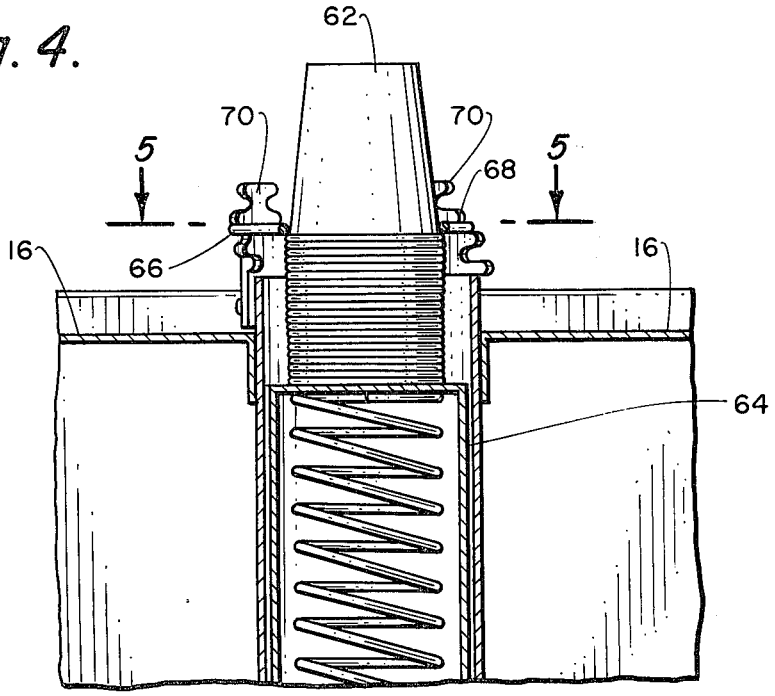
FIG. 4 is a sectional view illustrating the cup dispenser taken at 4—4 of FIG. 2.

Another unique feature of the medicine dispensing cart is the totally enclosed top delivery multi-size cup dispenser which can be adjusted to accomodate different size cups without the use of tools. The multi-size cup dispenser is illustrated in FIG. 4. The cups 62 sit on a spring-biased shelf 64 and are retained by a resilient band 66 engaging slots 68 and peripheral flanges 70 around the cup-dispensing aperture 24 in the upper surface 16. The flange 70 around the cup aperture 24 is stepped to permit the rubber band 66 to be easily moved to higher or lower slots thus enlarging or diminishing the opening as shown more clearly in FIG. 5.

Figure 5:
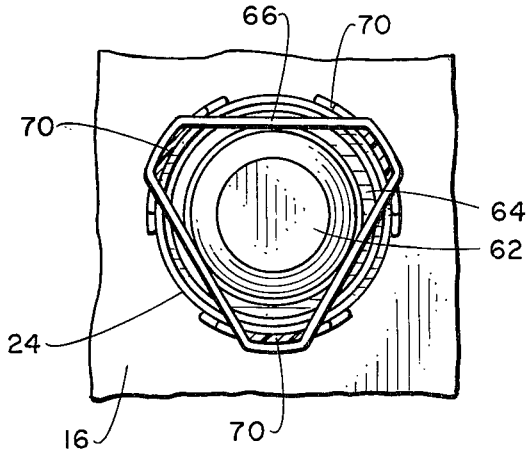
FIG. 5 is another view of the variable size cup dispenser taken at 5—5 of FIG. 4.

As shown in FIG. 5 there are three flanges 70 with the rubber band 66 engaging the middle slots in the flanges providing a triangular opening, slightly smaller than the aperture in the top surface 16 of the cart. As can readily be seen, moving the rubber band to the uppermost slots in the flanges 70 will reduce the somewhat triangular shape of the rubber band 60, thus providing retention for smaller cups. Conversely moving the rubber band to one of the lower positions on the peripheral flanges 70 will increase the triangular shape encompassed by the rubber band 66 allowing retention of larger cups. Thus, by simply moving the rubber band from one step to another step, different size cups in the dispenser can be quickly and easily accommodated.

Figure 6:
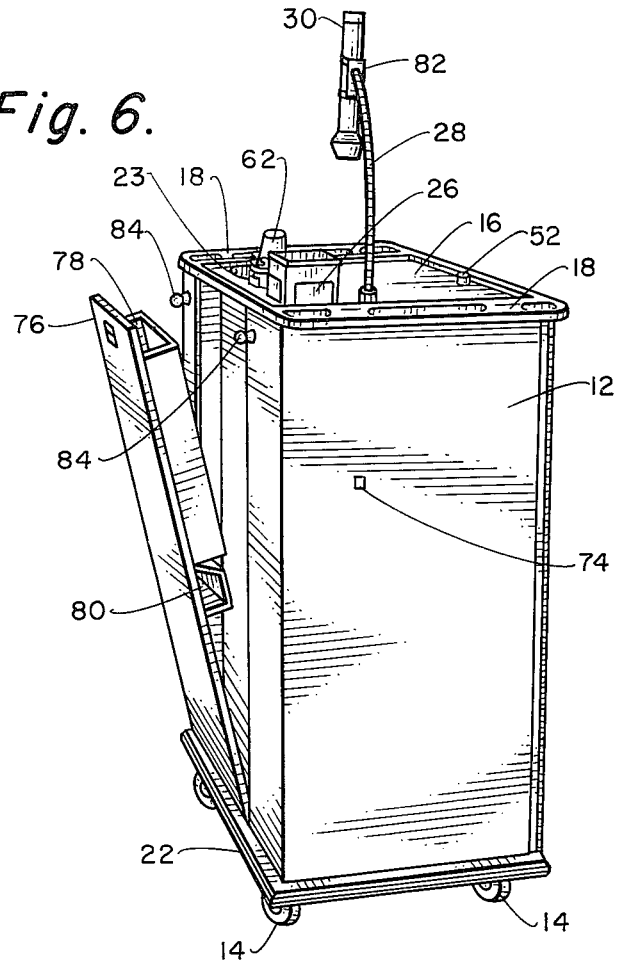
FIG. 6 is a perspective view illustrating the rear portion of the medication cart.

The perspective view shown in FIG. 6 is a view showing the rear and side of the cabinet 12 with the doors 32 and 34 closed. As was indicated previously, when the doors are open and swung to the side, latches 72 engage latches 74 to secure the doors 32 and 34 against the sides in an out-of-the-way position. In the rear of the cabinet a tilt-out panel 76 is provided which supports a waste receptacle 78 for supporting waste disposal bags. A plurality of plastic waste disposal bags is supported in a rack 80 for replacement of used waste bags. The waste bag servicing or replacement is automatic in that a full bag, when pulled up through the waste receptacle 78, automatically pulls an empty bag from the rack 80. The new waste bag is then folded around the lip of the waste receptacle 78. When the tilt-out panel 76 is closed, the waste receptacle is automatically in communication with the aperture 23 in the top or upper working surface of the cart 10.

Other features include a bracket 26 for securing a tray or bottle on the top of the cabinet and a flexible arm 28 having a bracket 82 for supporting a flashlight 30.

Figure 7:
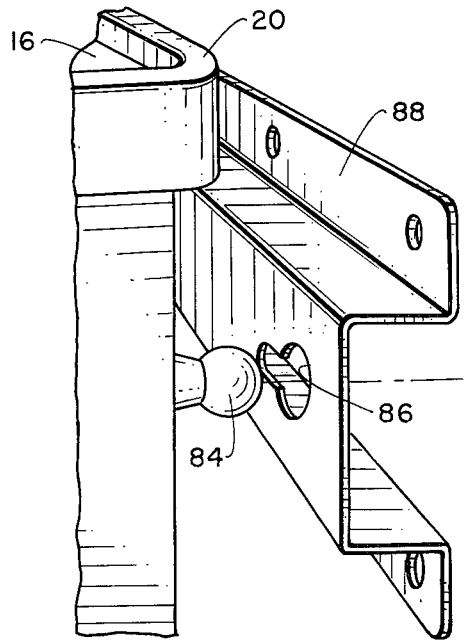
FIG. 7 is a detailed view illustrating the manner in which the cart is immovably locked to a rigid surface.
Figure 8:
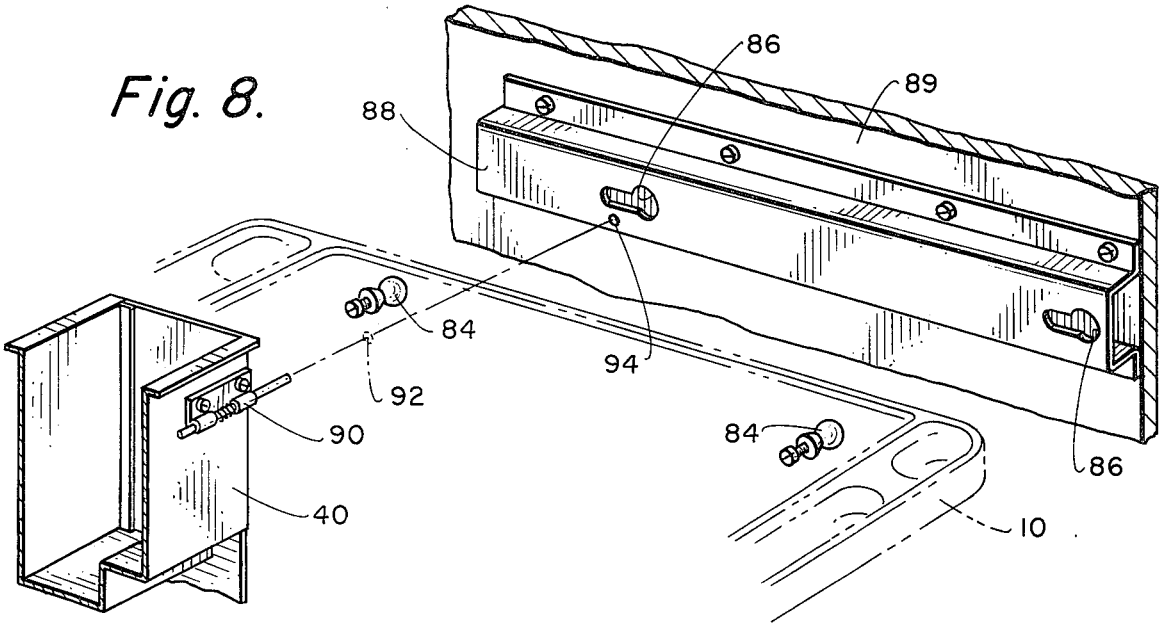
FIG. 8 is an exploded view of the wall-locking feature of FIG. 7.

A unique wall lock system is also provided in the basic cart construction, as shown in FIGS. 7 and 8. This is provided by two or more knobs or socket balls 84 secured to the rear of the cart which engage a keyhole slot 86 in a bracket 88 which can be securely fastened to a wall (FIG. 8) adjacent to a nursing station.

The unique wall lock system is shown in the exploded view of FIG. 8. The wall bracket 88 is fastened to the wall 89 and has keyhole slots 86 for engagement by knobs 84 attached to the rear of the cart 10. In order to lock the cart in this position, a spring lock plunger or pin 90, attached to the upper side of the narcotics drawer 40, passes through a hole 92 in the rear wall of the cart and engages a hole 94 in the wall bracket. Thus, the cart cannot be removed from the wall bracket once the plunger 90 has engaged the hole 94, unless the narcotics drawer is unlocked and pulled out approximately an inch or more. Pulling the narcotics drawer partly open removes the plunger or pin 90 from the hole 94, allowing the knobs 84 to be disengaged from the keyhole slots 86. This provides a double lock system because in addition to the narcotics drawer being lockable, the front doors 32 and 34 are also secured. Once the knobs 84 are engaged in the keyhole slot 86 and the cart positioned so that the spring lock plunger 90 snaps into the aperture 94 of the wall bracket 88, the cart cannot be moved sideways sufficiently to release the knobs from the keyhole slots.

Thus, there has been disclosed a new medication dispensing cart which has everything easily accessible and in the right place. In addition the cart has lockable controlled drug drawer security as well as being completely lockable. The unique arrangement of drawers and medication bins puts controlled drugs and floor supply medications within easy reach which eliminates a nurse's fatigue and lost time due to bending and straining. In addition, circling around the cart to find things is substantially eliminated. In addition, the unique vertical drawer with both top and side accessibility providing double lock security for controlled drugs, also at a high level, permits organization and control of drugs to eliminate errors and save nursing time. A second vertically oriented drawer with both top and side accessibility provides storage for floor supplies, keeping them secure, controlled and sanitary.

The tilt-out panel provides a totally enclosed automatic bag replacement waste receptacle which is easy to service and eliminates unsightly and unsanitary exterior waste containers. This improves efficiency, housekeeping and sanitary procedures. The top-delivery, multi-size cup dispenser to handle all size cups eliminates problems of purchasing separate cups to match the cup dispenser and permits size adjustment without any special tools.

Another important feature is the new wall lock assembly providing means for securing the cart to a wall adjacent to the nursing station for use as a medicine cabinet when the cart is not in use. The wall lock system eliminates the need for separate and additional lock and keys with the cart locking system doubling as a wall lock, if desired. The cart has all items totally enclosed and lockable with interchangeable cassettes providing versatile organization and arrangement.

In summary, the medication dispenser provides a totally enclosed, mobile medication station with easy access to all medication drawers, controlled drug drawer and supply drawers from one side of the cart. The interior of the cabinet also provides ample space for three or more removable cassettes of medication drawers which allows organization and arrangement to be interchangeably made.

Obviously, many modifications and variations of the invention are possible in light of the above teachings. It is therefore to be understood that the full scope of the invention is not limited to the details disclosed herein and may be practiced otherwise than as specifically described.

What is claimed is:

1. A portable medicine dispensing cart comprising:
a cabinet having a hollow interior enclosed by four sides, a bottom and a flat top working surface;
hinged door means on one side providing access to said hollow interior;
a plurality of medication storage bins slidably supported in removable wire rack cassettes in said hollow interior accessible behind said hinged door means;
a pair of lockable, slidably extendable, vertically oriented drawers, one above the other, adjacent to said plurality of medicated storage bins;
said vertical drawers being divided into a plurality of compartments with a compartment accessible from the top and a bottom compartment accessible from a side adjacent to said medication bins, whereby said vertical drawers and medication storage bins may be simultaneously accessible;
a cart wall locking security system comprising;
a wall bracket having a pair of horizontally aligned keyhole slots,
a pair of socket balls secured to the rear wall of said cabinet adapted to engage said horizontal keyhole slots of said bracket,
a hole in said wall bracket,
a spring-loaded pin extending out of the rear wall of said cabinet and adapted to engage the hole in said wall bracket when said socket balls are fully engaged in said keyhole slots,
holding means for holding said pin in an extended position when said cart is secured,
an adjustable size cup dispenser accessible through a circular aperture in said top surface comprising:
retaining means circumjacent said circular aperture in said top surface for retaining said cups; and
resilient means for adjusting said retaining means for different size cups.

2. The medication cart according to claim 1 wherein said holding means for holding said pin in an extended position when said cart is secured comprises:
a bracket secured to one of said vertical drawers;
a spring-loaded plunger pin slidably supported in said bracket;
whereby said plunger pin is held in an extended position whenever said vertical drawer is locked.

3. The apparatus according to claim 1 wherein said retainer adjusting means for said cup dispenser comprises:
a plurality of stepped flanges around the periphery of said circular aperture;
a removable resilient elastic band engaging the respective steps of said flanges for restricting the size of the circular opening, said size restriction being determined by which step of the plural flanges said resilient means is engaging.

4. The medication cart according to claim 1 wherein the side of said cabinet opposite said hinged doors includes:
a tilt-out panel;
a waste receptacle supported on said panel accessible through an aperture in said top working surface when said tilt-out panel is closed comprising:
a shelf rack attached to said tilt-out panel;
a roll of tear-off disposable plastic bags supported on said shelf;
a rectangular hollow bracket attached to said tilt-out panel above said shelf;
whereby a replacement waste bag is automatically pulled up through said rectangular hollow bracket when a full bag is removed.

* * * * *